United States Patent [19]

Fram

[11] Patent Number: 4,638,934

[45] Date of Patent: Jan. 27, 1987

[54] SLITTING AND DICING MACHINE FOR FIBERGLASS MAT AND MATS OF OTHER BRITTLE ABRASIVE FIBERS

[76] Inventor: Jerry Fram, 13231 Louvre St., Arieta, Calif. 91331

[21] Appl. No.: 656,863

[22] Filed: Oct. 2, 1984

[51] Int. Cl.[4] ..... B26F 3/00

[52] U.S. Cl. ..... 225/97; 83/122; 83/302; 83/346

[58] Field of Search ..... 83/302, 346, 348, 506, 83/507, 425.1, 118-122, 408, 422; 225/3, 4, 97

[56] References Cited

U.S. PATENT DOCUMENTS

| | | | |
|---|---|---|---|
| 1,062,627 | 5/1913 | Williams . | |
| 1,615,198 | 1/1927 | Blendow et al. . | |
| 3,296,911 | 1/1967 | McLane | 83/118 X |
| 3,317,100 | 5/1967 | Flemming et al. | 225/97 |
| 3,496,820 | 2/1970 | Utzman et al. | 83/302 |
| 3,869,268 | 3/1975 | Briar et al. | 83/347 X |
| 3,875,836 | 4/1975 | Hutchinson et al. | 83/302 X |
| 3,971,277 | 7/1976 | Kowalski et al. | 83/176 |
| 4,014,234 | 5/1977 | Spengler | 83/162 |
| 4,091,697 | 5/1978 | Cailey | 83/5 |
| 4,373,650 | 2/1983 | Gay | 225/97 |

FOREIGN PATENT DOCUMENTS

| | | | |
|---|---|---|---|
| 2315171 | 10/1974 | Fed. Rep. of Germany | 83/346 |
| 297602 | 10/1971 | U.S.S.R. | 83/302 |

*Primary Examiner*—James M. Meister
*Attorney, Agent, or Firm*—John H. Lynn

[57] ABSTRACT

A machine for slicing matting of brittle fiber material comprising an elastomeric coated anvil roller and a slicer roller having a plurality of cutting discs mounted on an axis parallel to the longitudinal axis of the anvil roller, which depress the matting into the elastomeric material of the anvil roller sufficiently to break the brittle fibers. The sliced matting can then be conveniently cut transversely on the same machine, if desired, to form diced brittle fiber matting. The diced matting, e.g., of fiberglass is a way of facilitating the separation of short fibers from fiberglass matting to produce raw material for forming new matting, or the diced brittle fiber matting, e.g., fiberglass or carbon fiber matting may be used as such.

7 Claims, 3 Drawing Figures

SLITTING AND DICING MACHINE FOR FIBERGLASS MAT AND MATS OF OTHER BRITTLE ABRASIVE FIBERS

FIELD OF THE INVENTION

The present invention relates to the field of slitting and dicing brittle and abrasive fiber material, for example, fiberglass or carbon fiber, which has been formed into sheets or mats. This process can be a means to obtain short fiber strands from sheets or mats.

BACKGROUND AND SUMMARY OF THE INVENTION

It is known in the art to cut fiberglass fibers which are initially in the form of long strands of fiberglass, on a machine having an anvil roller and a cutter roller. The strands of fiberglass are passed between the anvil roller and the cutter roller, with the anvil roller having an outer sleeve or cover made of an elastomeric material, for example, rubber, and the cutter blades on the cutter roll pressing into the elastomeric material, thereby cutting the strands of fiberglass. The cutting action can best be described as bending the fibers sufficiently to cause the brittle fibers to break. The cut fibers are then used for purposes well known in the art. Such a machine is manufactured by Finn and Fram, Inc. of Arieta, Calif.

Some fiber production processes yield the fibers in the form of sheets or mats rather than in long strands. To produce short lengths of fibers from sheets or mats, the sheets or mats may be first slit and then cut to length. At this point, if the mat is loose, it may separate by itself into individual cut fibers. If, however, the mat fibers adhere to each other, then the diced squares could be used as they are or separated into individual fibers in a subsequent operation.

In some processes, matting made from fiberglass or other fibers is cut and shaped into forms, for example as defined by a mold, after which a setting resin is added to form a final product. A by-product of such operations is waste matting, which often of little use and is discarded causing loss due to the inability to use the discarded waste.

It is also known in the art that other materials, such as carbon fiber materials ma be formed into mats or sheets. One use for a matting of a kind made from the carbon fiber is for use in automobile brake linings. This generally requires the matting to be cut into smaller pieces of the generally square or rectangular shape.

There exists therefore in the art a need for a machine to conveniently convert brittle fiber material in the form of a matting or sheet into smaller pieces of the generally square or rectangular shape. In the case of the carbon fiber material, these diced pieces may be useful in and of themselves. For certain fiberglass molding jobs, the diced fiberglass matting may also be useful in and of itself. In addition, the diced matting of fiberglass material, depending upon the initial manner of forming the matting from which the diced material is obtained, may be useful as a first step toward separating individual fibers of fiberglass from the small pieces resulting from dicing waste mats of fiberglass material in mat form, to thereby obtain fibers useful for making new mats and for reinforcement in composite materials as is known in the art. In this manner, the waste fiberglass matting may be used to create diced fiberglass matting or to recover fiberglass fibers from the waste matting, which fibers are then useful in creating new matting and for other applications.

Several principles of slitting mats like fiberglass are known in the art. These could in principal be used to slit such mats immediately prior to cross cutting with a fiberglass cutter for long strands as described above in order to dice the material as required.

The present invention incorporates a novel slitting principal which can be economically integrated into a fiberglass cutter for the purpose of dicing the sheets or matting of brittle abrasive fibers. An object of the present invention is to provide this novel slitter both by itself and also in combination with a fiberglass cutter for the purpose of dicing sheets or matting of brittle abrasive fibers.

The novel slitter of the present invention features a slicer-roller in conjunction with the anvil roller, with the slicer-roller having a plurality of discs which depress the matting into the elastomeric material of the anvil roller sufficiently to break the brittle fiber material, thereby converting the matting into strips. Feed fingers on the mat between the discs press the mat against the anvil roll insuring a positive feed action and preventing the mat from getting caught between the discs. The slicer-roller pressure against the anvil roller is adjustable so that the correct pressure can be applied for a clean slitting action without excessive pressure which might slice into the anvil roller. After passing through the slicer-roller, the strips are then fed between the anvil roller and cutting roller which cuts the strips between successive cutting blades on the cutter roller, thereby forming diced fiber matting of a generally square or rectangular shape.

It is, therefore, a general object of the present invention to provide a machine which will slit and also dice fiberglass or other brittle abrasive fiber material in the form of sheets or matting.

A feature of the present invention resides in the utilization of a slicer-roller alone, and also in conjunction with the cutter roller to perform dicing, with the slicer-roller having a plurality of cutting discs which depress the matting into the elastomeric material of the anvil roller sufficiently to break the brittle fiber material forming the mat, thereby converting the matting into strips of brittle fiber material. The strips are then conveniently fed between the anvil roller and a cutting roller which cuts the strips between successive cutting blades on the cutter roller, thereby forming diced fiber matting having a generally square or rectangular shape. Another feature of the present invention is to provide for a variable pressure application for the slicer-roller against the anvil roller.

A further feature of the present invention is to provide feed fingers to guide the matting, after it is sliced, into the operating zone of the cutting roller and anvil roller.

These features of the present invention have been given to broadly understand the present invention and in order to more fully appreciate the invention as described below in further detail. These and other features of the present invention will be further understood by reference to the detailed description and the drawings in which like-reference numerals have been used to identify like elements.

DETAILED DESCRIPTION OF A PREFERRED EMBODIMENT

Figure 1:
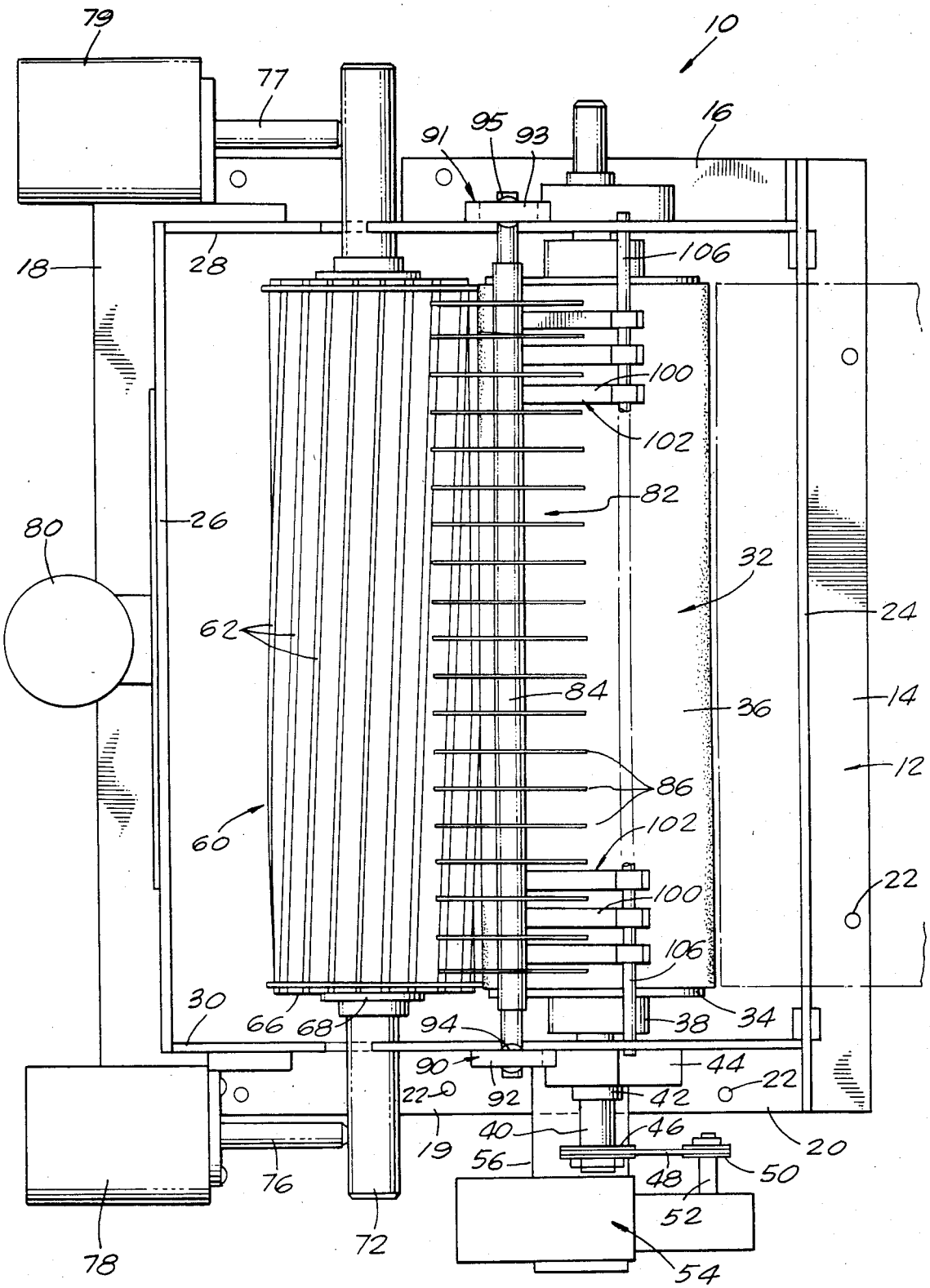
FIG. 1 shows a plan view of a brittle fiber matting dicing machine according to the present invention with the nipper guard removed for the purpose of illustration.

Starting first with FIG. 1 there is shown a brittle fiber matting dicing machine 10 according to the present invention. The machine has a base 12 which includes a plurality of L-shaped bracket numbers 14, 16, 18, 19 and 20, each of which has one or more bolt holes 22 for mounting the machine. A front wall 24 stands vertically upward from its attachment to the bracket 14. The rear wall 26 extends vertically upward from its attachment to the bracket 18. The sidewall 28 extends vertically upward from its attachment to the bracket 16 and a portion of the bracket 18, extending along the base of the sidewall 28. The sidewall 30 extends vertically upward from its attachment to the brackets 19 and 20.

The machine includes an anvil roller generally designated as 32. The anvil roller has an anvil roller drum 34, the outer surface of which is covered with a coating or sleeve 36 of elastomeric material, for example, rubber in a manner known in the art of cutting fiberglass fibers. The anvil roller drum 34 is mounted concentrically on driveshaft 40 with two hubs 38. The driveshaft is driven by a gearmotor 54 by means of a roller chain 48.

The machine also includes a cutter roller generally indicated as 60. The cutter roller has a plurality of cutting blades 62 mounted to its surface. These blades 62 can be arranged in a helix on the outer surface of the cutter roller 60 for lower vibration in operation or they can be square. The outer surface of the cutter roller 60 is formed by a cutter drum 66 which is rotatively mounted with bearings 68 on a non-rotating cutter shaft 72. The protruding shaft 72 is slidably mounted in a slot 74 (shown in FIG. 2) in the sidewall 30 with a corresponding slot existing in the sidewall 28. Milled flats in the shaft 72 prevent it from rotating in the slots 74. The cutter roll 60 is urged against the anvil roller 32 with a constant pressure by the means of the pair of driverods 76 and 77, each controlled by a pneumatic or hydraulic ram, respectively 78 and 79.

The pneumatic or hydraulic rams 78 and 79 are supplied with pressurized air or oil, as appropriate, from a reservoir 80.

Disposed above the anvil roller 32 is a slicer roller 82 having an internal shaft 84 upon which are mounted a plurality of slicing discs 86. The internal slicing roller shaft 84 extends through and is rotatably mounted upon a slide member 96 (shown in FIG. 2). The slide member 96 is slidably mounted in a mounting bracket 90 attached to the sidewall 30, with a similar mounting bracket 91, containing a slide member (not shown), attached to the sidewall 28. Each of the mounting brackets 90, 91 has a top plate, respectively 92, 93, to which is attached a pneumatic ram, respectively, 94, 95. The pneumatic rams 94, 95, urge the slide members 96 downwardly under a controlled pressure to control the pressure at which the cutting discs 86 engage the elastomeric surface 36 of the anvil roller 32.

Figure 2:
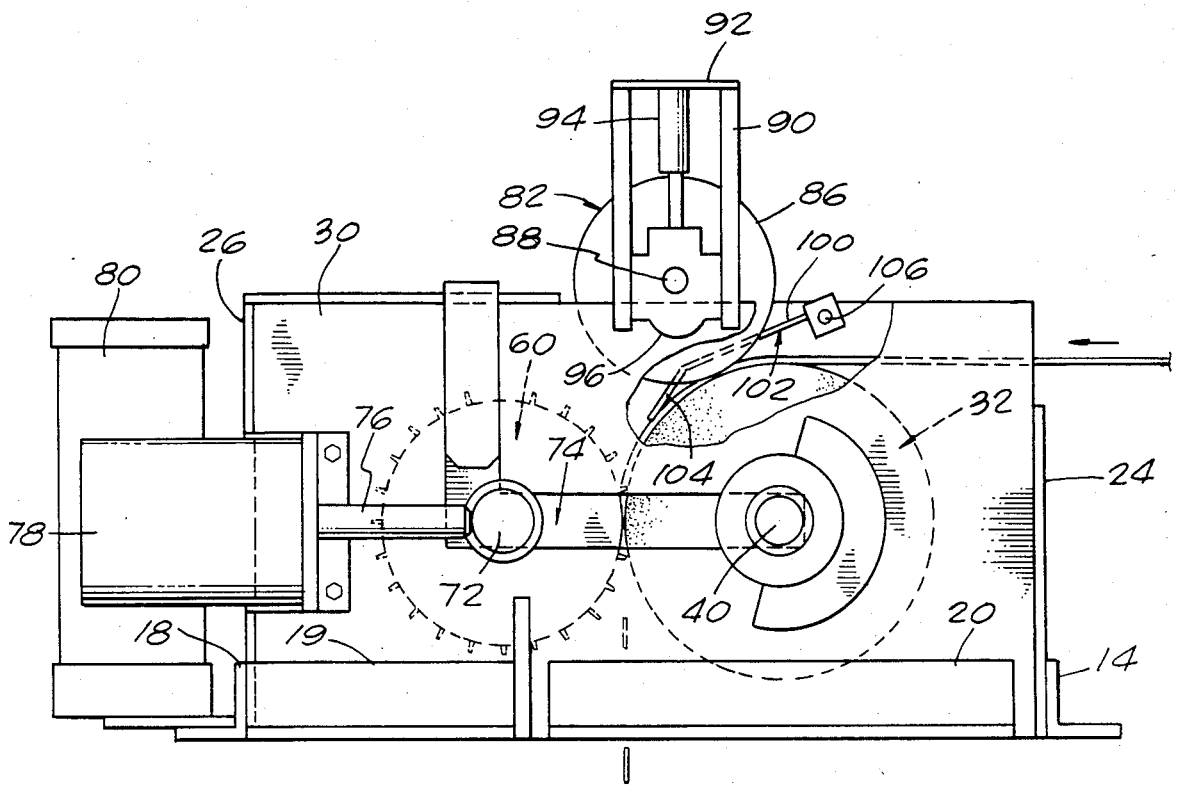
FIG. 2 shows a side elevational view of the apparatus shown in FIG. 1 with certain features such as the nipper guard and feed fingers, not shown in FIG. 1, illustrated in FIG. 2.
Figure 3:
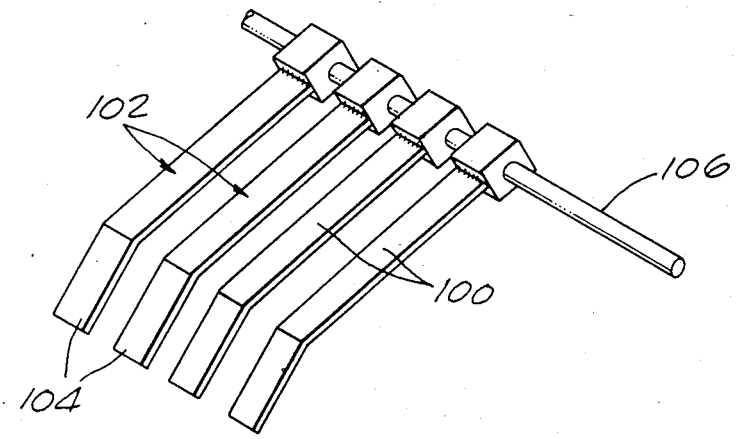
FIG. 3 shows a perspective view of one of the feed fingers according to the present invention.

Turning now to FIG. 2, there is shown the disposition of the slicer roller 82 above the anvil roller 32 being urged into engagement with the anvil roller 32 by the pneumatic ram 94 (and also 95 which is not shown in FIG. 2). A plurality of feed fingers 100 are mounted on a shaft 106 which is mounted on the sidewalls 28 and 30. The feed fingers 100, shown in perspective view in FIG. 3, are of a width sufficiently narrow to allow them to fit between the cutting discs 86 of the slicer roller 82, with a feedfinger 100 extending between each pair of adjacent cutting discs 86. The feed fingers have a bent portion 104 at the terminal end thereof which is bent towards the working zone of the cutter roller 60 and anvil roller 32.

In operation, a mat of brittle fiber material, e.g. fiberglass, is fed along the feed path indicated by the arrows pointing left in FIG. 2. The cutting discs 86 of the slicer roller 82 depress the matting into the elastomeric material 34 of the anvil roller 32 sufficiently to break the brittle fibers forming the matting, thereby slicing the matting into a plurality of strips along lines oriented in the direction of the travel of the matting between the anvil roller 32 and slicer roller 82, i.e., circumferentially of the anvil roller 32. The bent portion 104 of each of the feed fingers 100 direct the strips of sliced brittle fiber matting material downwardly toward the working zone of the cutter roller 60 and anvil roller 32, where the cutting blades 62 engage the elastomeric material 34 of the anvil roller 32. The cutting blades 62 of the cutter roller 60 depress the sliced brittle fiber matting into the elastomeric material of the anvil roller 32 sufficiently to break the brittle fiber material of the strips along lines generally transverse to the direction of movement of the strips of brittle fiber material between the anvil roller 32 and cutter roller 60.

The resulting product is diced brittle fiber matting having a generally rectangular or square configuration. It will be understood that the configuration is not exactly square where the cutting blades 62 are arranged in a helix on the cutter roller 60. If exactly square or rectangular diced pieces are desired, the cutting blades 62 can be arranged longitudinally of the circumferential surface of the cutter roller 60.

In the case of certain brittle fiber materials, for example, brittle fiber made from carbon material and brittle fiberglass matting, the diced pieces are useful in and of themselves. In addition, when the matting is fiberglass material, the diced matting can be used to recover short fibers of fiberglass material, from which such matting was originally made. This can be done by taking the diced fiberglass matting and processing it, e.g. as by raking or agitation, or a combination of the two to separate the short fibers within the diced piece of fiberglass material from the diced piece of fiberglass material. In other cases, the fibers of the diced pieces, being held together loosely, separate by themselves and can be used as such. The particular manner of separating the short fibers within the diced piece of fiberglass material forms no part of the present invention. However, the machine of the present invention can be useful for converting waste fiberglass matting into the diced pieces, from which short fibers may be much more easily removed than from waste matting as typically is left over from molding processes. Therefore, the present invention is useful as part of a process for converting the waste matting into such short fibers which may in turn by used to produce new fiberglass matting by any of a number of means well known in the art.

A Summary of the Scope and Advantages of the Present Invention

It will be seen that the present invention provides an apparatus for converting brittle fiber material in the form of mats or sheets into diced generally rectangular shaped pieces which may be useful in their own right for certain applications, or, in the case of fiberglass matting may be useful to convert waste fiberglass to a form from which can be extracted quite easily short fibers useful in making fiberglass matting. The use of the slicer-roller having a plurality of cutting discs which depress the brittle fiber material matting into the resilient elastomeric material of the anvil roller, in a direction parallel to the direction of movement of the matting between the slicer cutter roll and the anvil roll, forms the matting into strips which are then guided to between the anvil roller and cutter roller to be further cut into generally rectangular pieces.

The above description of the preferred embodiment of the invention is intended for explanation and illustration. It will be understood by those skilled in the art that modifications and changes to the above described embodiment may be made without departing from the scope of the appended claims. The appended claims are intended to cover all such changes and modifications which do come within the scope of the claims.

What is claimed is:

1. Apparatus for slitting matting of brittle fiber material, comprising:

a frame;

a generally cylindrical anvil roller rotatably mounted on the frame, the outer cylindrical surface of the anvil roller having its outer cylindrical surface substantially covered with an elastomeric material;

a generally cylindrical cutter roller rotatably mounted on the frame;

a plurality of cutting blades disposed lengthwise on an outer surface of the cutter roller, the cutter roller being mounted with respect to the anvil roller such that the cutting blades deform the elastomeric surface of the anvil roller sufficiently to cut brittle fiber material by breaking the fibers;

a slicing roller including a plurality of spaced-apart cutting discs rotatably mounted on an axis parallel to the axis of the anvil roller and disposed with respect to the anvil roller such that the cutting discs on the slicing roller deform the elastomeric material on the anvil roller sufficiently to cut brittle fiber material by breaking the fibers;

a plurality of feed fingers resiliently mounted adjacent the anvil roller, each feed finger extending between adjacent cutting discs extending from the slicing roller, each feed finger having a distal end bent in the direction of the line of contact of the anvil roller and the cutter roller;

means for spring biasing the feed fingers toward the anvil roller; and a feed path through which the mats of brittle fiber material are fed, first between the slicer roller and the anvil roller and, second, between the cutter roller and the anvil roller.

2. The apparatus of claim 1 further comprising:

the cutting blades on the cutter roller being helically disposed on the outer cylindrical surface of the cutter roller.

3. The apparatus of claim 1 further comprising;

the cutting blades on the cutter roller being aligned generally parallel to the longitudinal axis of the cutter roller.

4. The apparatus of claim 1 further comprising:

the slicer roller being slideably mounted and urged downwardly into engagement with the anvil roller.

5. The apparatus of claim 1, further comprising:

the cutting blades on the cutter roller being helically disposed on the outer cylindrical surface of the cutter roller; and at least one of the anvil roller and cutter roller being slideably mounted on the frame and urged into engagement with the other of the anvil roller and cutter roller.

6. The apparatus of claim 4, further comprising:

the slicer roller having a cylindrical portion disposed on a shaft rotably mounted above the anvil roller, with a plurality of disc-like protrusions extending from the outer cylindrical surface on the cylindrical portion, generally at right angles to the longitudinal axis of the cylindrical portion.

7. Apparatus for slitting matting of brittle fiber material, comprising:

a frame;

an anvil roller rotatably mounted on the frame, the anvil roller having an outer surface substantially covered with an elastomeric material;

a cutter roller rotatably mounted on the frame;

a plurality of cutting blades disposed on an outer surface of the cutter roller, the cutter roller being mounted with respect to the anvil roller such that the cutting blades deform the elastomeric surface of the anvil roller to cut brittle fiber material;

a slicing roller including a plurality of spaced-apart cutting discs rotatably mounted on an axis parallel to the axis of the anvil roller and disposed with respect to the anvil roller such that the cutting discs on the slicing roller deform the elastomeric material on the anvil roller sufficiently to cut brittle fiber material by breaking the fibers;

a plurality of feed fingers resiliently mounted adjacent the anvil roller, each feed finger extending between adjacent pairs of the cutting discs, each feed finger having a distal end bent in the direction of the line of contact of the anvil roller and the cutter roller;

means for spring biasing the feed fingers toward the anvil roller; and a feed path through which the mats of brittle fiber material are fed, first between the slicer roller and the anvil roller and, second, between the cutter roller and the anvil roller.

* * * * *